United States Patent [19]

Baker

[11] Patent Number: 4,889,020

[45] Date of Patent: Dec. 26, 1989

[54] OPEN END RATCHET TYPE WRENCH

[76] Inventor: David R. Baker, 7254 Laurie Dr., Fort Worth, Tex. 76112

[21] Appl. No.: 91,099

[22] Filed: Aug. 31, 1987

[51] Int. Cl.[4] ..... B25B 13/04

[52] U.S. Cl. ..... 81/119; 81/186

[58] Field of Search ..... 81/119, 186, 176.1, 81/176.2

[56] References Cited

U.S. PATENT DOCUMENTS

| | | |
|---|---|---|
| 2,618,996 | 11/1952 | Logan . |
| 2,652,735 | 9/1953 | Wilder . |
| 2,685,219 | 8/1954 | Diebold . |
| 2,730,000 | 1/1956 | Crittenden, Jr. . |
| 2,937,551 | 5/1960 | Akers . |
| 3,059,513 | 10/1962 | Ness . |
| 3,745,859 | 7/1973 | Evans et al. . |
| 3,757,614 | 9/1973 | Evans et al. . |
| 3,762,244 | 10/1973 | Evans . |
| 3,868,873 | 3/1975 | Evans . |
| 3,881,377 | 5/1975 | Evans et al. . |
| 3,921,474 | 11/1975 | Dyck et al. . |

OTHER PUBLICATIONS

Photos of Quali-Kraft Wrench.

*Primary Examiner*—Frederick R. Schmidt
*Assistant Examiner*—Lawrence Cruz
*Attorney, Agent, or Firm*—James E. Bradley

[57] ABSTRACT

An open end wrench for use with a nut allows ratcheting of the wrench without removing the wrench from the nut. The wrench has fixed upper and lower jaw portions. An upper primary drive face and an upper secondary drive surface are located on the upper jaw portions. A lower primary drive face and a lower secondary drive face are located on the lower jaw portions. A rear stop face is located at the junction of the upper and lower jaw portions. Clearances are provided in the upper and lower jaws to enable the wrench to be rotated relative to the nut either approximately 30 degrees from a primary to a secondary drive position, or 60 degrees from primary to primary drive positions.

8 Claims, 5 Drawing Sheets

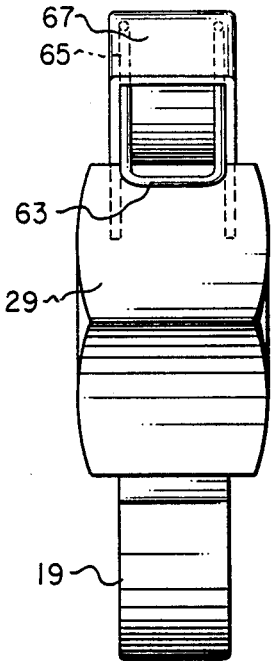
Fig. 5
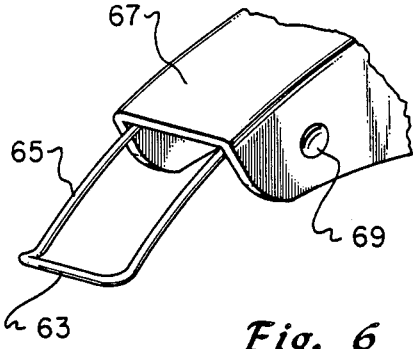
Fig. 6
Fig. 7
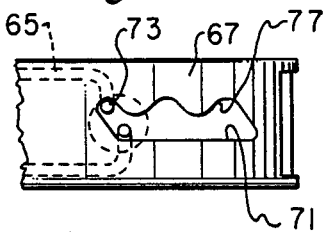
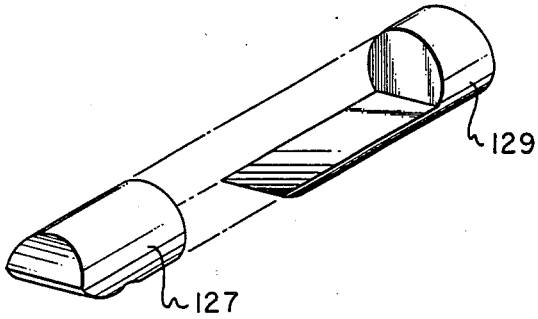
Fig. 11

OPEN END RATCHET TYPE WRENCH

BACKGROUND OF THE INVENTION

1. Field of the Invention

This invention relates in general to wrenches, and in particular to an open end wrench that provides ratcheting action.

2. Description of the Prior Art

In a conventional open end wrench, a rigid jaw is joined to a shank. The jaws have parallel faces which slide over the sides of the nut. After each stroke, the user must remove the wrench from the nut and reposition it on the nut. Typically the nut is hexagonal, with a point or corner every 60 degrees. If an obstruction prevents repositioning a full 60 degrees, the user must also flip the wrench over with each stroke. This makes using such a wrench timeconsuming. Also, because of the necessary clearances between the sides of the nut and the two parallel drive surfaces, the actual contacting drive points are on the corners of the nut. This tends to round the corners, particularly when high torque is required.

A number of patents have issued disclosing open end wrenches that will ratchet. That is, the user is able to reposition the wrench on the nut for another stroke without having to completely remove the wrench from the nut. The designs have various deficiencies. Many of them drive only on the corners of the nut, tending to cause the nut to round at the corners. Of the fixed jaw type, each stroke must be 60 degrees from the preceding stroke. That is, the user must ratchet the wrench from one corner to the next corner of the nut. An intermediate position is not available. Also, the fixed jaw types require that the wrench be pulled away from the nut with each repositioning stroke. The next position is not self-seeking.

A wrench that is self seeking would have the characteristic of ratcheting from one driving position to the next while being held in contact with the nut. This self seeking characteristic would be due entirely to the design of the various surfaces, faces, points and angles of the wrench in relation to the nut to be turned, and would not require special positioning of the wrench by the user.

SUMMARY OF THE INVENTION

The wrench of this invention has fixed upper and lower jaw portions. The upper jaw portion has an upper primary drive face and an upper secondary drive point or face. The lower jaw portion has a lower primary drive face and a lower secondary drive face. A rear stop face is located at the junction of the upper and lower jaw portions. There are also upper and lower stop faces located adjacent the drive faces. The distance between the stop faces is greater than the corner to corner diameter of the nut, to enable the wrench to be rotated between the primary drive position and a secondary drive position. The primary and secondary drive positions are on the average thirty degrees rotationally apart from each other. In the single piece, fixed jaw versions, the wrench is moved slightly rearward when moved to the secondary drive position. These versions automatically seek the next primary drive position when moving from primary drive position.

In another embodiment, a retainer clips to the upper jaw. The retainer extends past the free end of the jaw. It serves as a stop or locating point for the wrench when the wrench moves rearward to the secondary drive position. The retainer can be retracted when not being used.

Another embodiment of the invention uses a pawl. The pawl is slidably carried in the upper jaw. It provides a secondary drive point or face. It retracts as the wrench is rotated between strokes. In this embodiment, it is not necessary to move the wrench rearward when moving from the primary drive position to the secondary drive position.

BRIEF DESCRIPTION OF THE DRAWINGS

FIG. 5 is an end view of the wrench and retainer as shown in FIG. 4.

FIG. 6 is a partial perspective view of the forward portion of the retainer shown in FIG. 4.

FIG. 7 is a partial view of the top of the retainer of FIG. 4.

FIG. 11 is a perspective view of the pawl and carrier used with the wrench of FIG. 10.

DESCRIPTION OF THE PREFERRED EMBODIMENT

Figure 1:
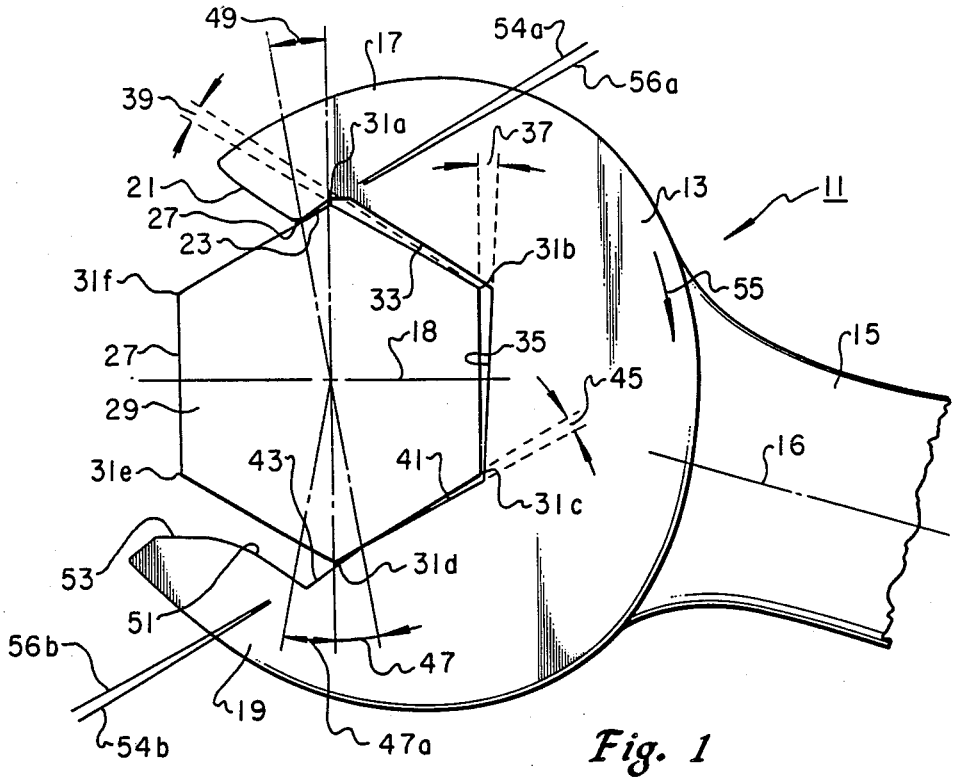
FIG. 1 is a side view of a wrench constructed in accordance with this invention and shown in the primary drive position.

Referring to FIG. 1, wrench 11 has a single piece rigid jaw 13. Jaw 13 is formed on the end of a shank 15. The axis 16 of shank 15 intersects the center line 18 of jaw 13 at an angle of about 15 degrees.

The center line 18 divides the jaw 13 into an upper jaw portion 17 and a lower jaw portion 19, both of which are rigidly formed together. The upper jaw portion 17 has a curved free end 21 that is formed at an angle of about 30 degrees relative to the center line 18. An upper primary drive face 23 extends rearward from the free end 21. The upper primary drive face 23 is a flat surface located at an angle of 120 degrees relative to the free end 21. The upper primary drive face 23 is located at an angle slightly greater than 30 degrees and preferably 31.5 degrees relative to the center line 18. The intersection of the free end 21 and the upper primary drive face 23 serves as an upper secondary drive surface 25. The upper secondary drive surface 25 is essentially a line, but the intersection is rounded slightly.

The upper primary drive face 23 and the upper secondary drive surface 25 are adapted to engage a side 27 of a nut 29. The nut 29 is hexagonal, having six corners or points 31*a*, 31*b*, 31*c*, 31*d*, 31*e* and 31*f*. Each side 27 intersects an adjacent side at an angle of 120 degrees.

The length of the upper primary drive face 23 is about one-fourth the length of one of the sides 27. In the primary drive position, shown in FIG. 1, one of the sides 27 is parallel to the upper primary drive face 23, providing a plane surface contact that is about 25% the length of one side 27.

An upper stop face 33 extends rearward from the upper primary drive face 23. The upper stop face 33 intersects the upper primary drive face 23 at an obtuse angle of 116.5 degrees. The upper stop face 33 is parallel to the free end 21. The length of the upper stop face 33 is about the same length as one of the sides 27 of nut 29.

A back stop face 35 extends downward from the upper stop face 33 at a 120 degree angle. Back stop face 35 is at an angle of 93.5 degrees to the center line 18. Because of the inclination of the primary drive face 23 relative to the back stop face 35, while in the primary drive position, the side 27 of nut 29 adjacent the back stop face 35 will not be parallel to the back stop face 35. The angle 37 between the side 27 and the back stop face 35 is about 3.5 degrees. A clearance also exists between the upper stop face 33 and the adjacent side 27 of nut 29 while in the primary drive position. The side 27 is at an angle 39 of about 3.5 degrees relative to a plane parallel to the upper stop face 33. The side 27 adjacent the back stop face 35 will touch the back stop face 35 at a point near the bottom of the back stop face 35.

A slide face 41 extends forward from the lower edge of the back stop face 35. The slide face 41 is a flat surface and intersects the back stop face 35. The angle of intersection is 120 degrees. The slide face 41 extends about half the length of a side 27 of nut 29. It intersects a lower primary drive face 43. The angle 45 between the planes containing the slide face 41 and the lower primary drive face 43 is 3.5 to 6 degrees.

The lower primary drive face 43 extends about three-fourths the length of a side 27 of nut 29. The lower primary drive face 43 is parallel to the upper primary drive face 23. A line normal to the lower primary drive face 43 would intersect a plane containing the upper primary drive face 23 at a distance equal to the nut diameter between sides 27. In the primary drive position, the lower primary drive face 43 contacts a flat surface of a side 27 for a distance corresponding to the angle 47. Angle 47 is preferably 10 degrees. Similarly, the upper primary drive face 23 contacts a surface of the opposite side 27 for a distance that corresponds to the angle 49. Angle 49 is the same as angle 47.

Angle **47*a* extends in the opposite direction from angle 47 and is the same quantity, preferably 10 degrees. Angle 47*a* is measured from a line that passes through the points 31*a* and 31*d*. Angle 47*a* intersets the forward end of the lower primary drive face 43. In the primary drive position shown in FIG. 1, the point 31*d* is positioned a distance proportional to angle 47*a* from the forward end of the lower primary drive face 43**.

A lower stop face 51 extends from the forward edge of the lower primary drive face 43 at an obtuse angle of 120 degrees. The lower stop face 51 is flat and is substantially parallel to the upper stop face 33. The perpendicular distance between the lower stop face 51 and the upper stop face 33 is slightly more than the distance between two opposite points 31 of nut 29. In the primary drive position shown in FIG. 1, a substantial clearance will exist between the lower stop face 51 and the side 27 located between points **31*d* and 31*e*. The angle of intersection between the lower stop face 51 and the slide surface 41 is 117.5 degrees. The forward end of the lower stop face 51** is slightly curved.

Line **54*a* in FIG. 1 is parallel to the upper primary drive face 23. Line 54*b* is parallel to the lower primary drive face 43. Line 56*a* is parallel to the side of nut 29 between points 31*a* and 31*f* when the wrench is in the primary drive position. Line 56*b* is parallel to the side of the nut 29 between points 31*c* and 31*d* when the wrench is in the primary drive position. The angular difference between lines 54*a* and 56*a* is one degree. Similarly, the angular difference between lines 54*b* and 56*b*** is one degree.

A flat lower secondary drive face 53 extends forward from the lower stop face 51. The intersection of the lower stop face 51 and the lower secondary drive face 53 is curved. The lower secondary drive face 53 is perpendicular to the back stop face 35 and parallel to the center line 18. A plane containing the lower secondary drive face 53 would intersect the lower stop face 51 at an obtuse angle of 211 degrees. A plane containing the lower secondary drive face 53 would intersect the lower primary drive face 43 at an obtuse angle of 149 degrees. The perpendicular distance between a plane containing the lower stop face 51 and the free end 21 is equal to the distance between opposite sides 27 of nut 29, plus a standard manufacturing tolerance. The distance between the forward edge of free end 21 and the forward edge of the lower secondary drive face 53 is about 20% greater than the diameter of nut 29 between sides 27.

Figure 2:
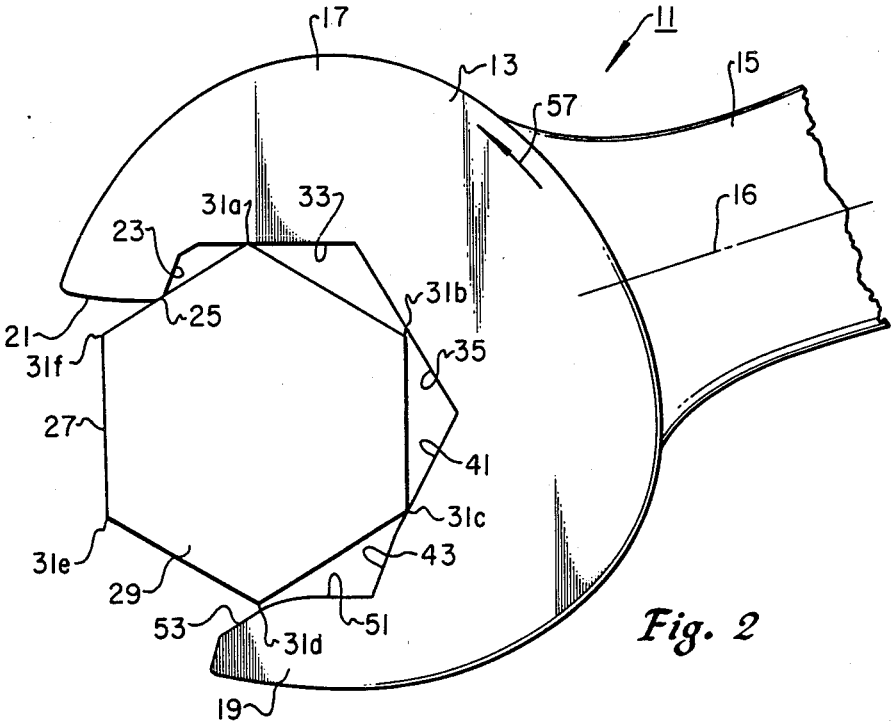
FIG. 2 is a side view of the wrench of FIG. 1, and shown in the process of rotating to a secondary position.
Figure 3:
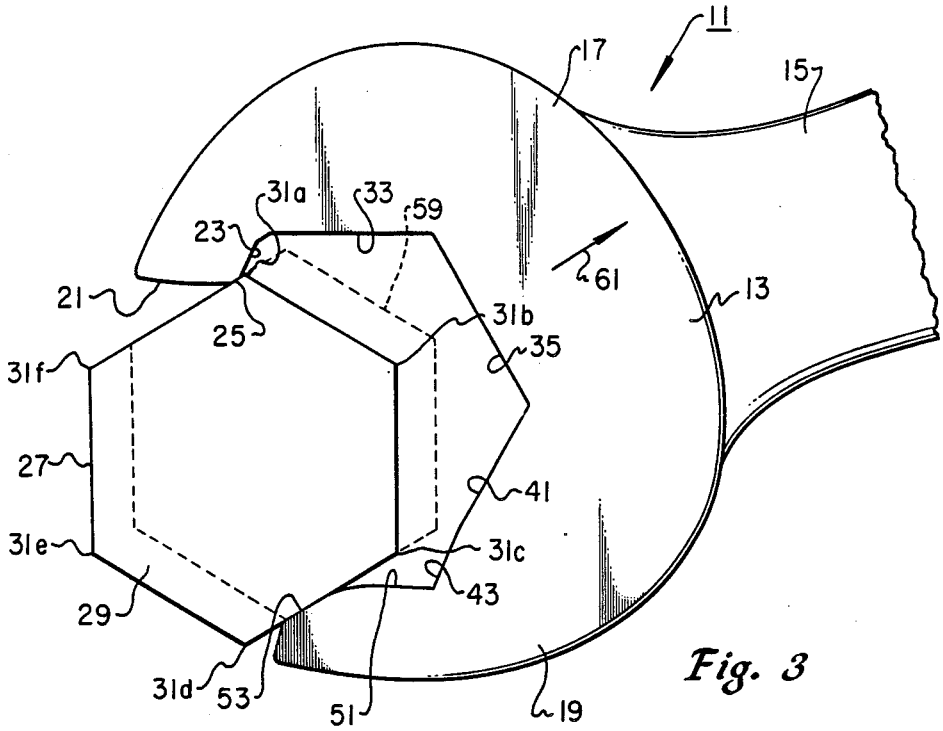
FIG. 3 is a side view of the wrench of FIG. 1, showing the wrench in a secondary drive position.

In the operation of the embodiment of FIGS. 1–3, the wrench 11 is placed around nut 29 by moving the wrench 11 forward relative to nut 29 with the side 27 between points **31*e* and 31*d* sliding against the lower secondary drive face 53 until the lower primary drive face 43 touches the side 27 between the points 31*c* and 31*d*. Then the wrench 11 is pushed forward and downward slightly until the point 31*c* touches the back stop face 35. A flat portion of the side 27 between points 31*a* and 31*f* will be in substantial parallel contact with the upper primary drive face 23. A flat portion of the side 27 between points 31*c* and 31*d* will be in substantial parallel contact with a portion of the lower primary drive face 43. Torque is applied in the direction of arrow 55. The force will act on the surfaces of the opposite sides 27, not on the corners or points 31*a* and 31*d*. Torque will cause the primary drive faces 23 and 43 to close the one degree angle between lines 54*a* and 56*a* and lines 54*b* and 56*b* and come into full parallel contact with the nut sides 27**.

Then, at the completion of the stroke, the user rotates the wrench in reverse to a new stroke, as shown by the arrow 57 in FIG. 2. The user has an option of rotating a full 60 degrees or more relative to nut 29 for a new stroke in the primary drive position of FIG. 1. If so, the user maintains a light forward pressure on wrench 11 during reverse rotation, and the wrench will automatically slide into the next primary drive position.

In the alternative, if space prevents a full 60 degree rotation, the user can rotate the wrench 11 only approximately 30 degrees for an intermediate or secondary drive postion, which is shown in FIG. 3. As the user begins to rotate counterclockwise as shown by arrow 57 in FIG. 2, he should maintain a slight forward pressure on the wrench 11. The upper stop face 33 will slide on point **31*a*. The back stop face 35 will slide on point 31*b*. The slide face 41 will slide on point 31*c*. The curved area between the lower stop face 51 and the lower secondary drive face 53 will clear the point 31***d*. When the rotation is about 30 degrees, or more precisely 27 degrees, the nut 29 will be in the position shown in FIG. 2.

Then, to place the wrench in the secondary drive position, the user moves the wrench rearward, as shown by arrow 61 in FIG. 3. The wrench will move rearward relative to the nut 29, as indicated by the dotted lines 59. Point 31*b* will be spaced a considerable distance from the back stop face 35. Torque can then be applied in the clockwise direction. The upper secondary drive surface 25 will act on the side 27 between points 31*a* and 31*f*, near the point 31*a*. The lower secondary drive face 53 will act on the side 27 between the points 31*c* and 31*d*, and near the point 31*d*. The secondary drive position will work at any position between the solid lines in FIG. 3 and the dotted lines 59.

If desired, a reverse torque can be applied while in the secondary drive position. This position is not shown, but it consists of rotating the wrench 11 counterclockwise from the secondary drive position shown in FIG. 3 while maintaining the point 31*b* spaced from the back stop face 35. The upper secondary drive surface 25 would engage the side 27 between points 31*a* and 31*f* and close to point 31*f*. The lower secondary drive face 53 would engage the side 27 between points 31*c* and 31*d* and near point 31*c*. In the secondary drive position, whether applying forward or reverse torque, a large clearance will exist between point 31*b* and the backface 35.

To move from the secondary drive position shown in FIG. 3 back to the primary drive position shown in FIG. 1, the user pushes forward on wrench 11 and rotates counterclockwise. The wrench 11 will slide back into the primary drive position automatically.

Figure 4:
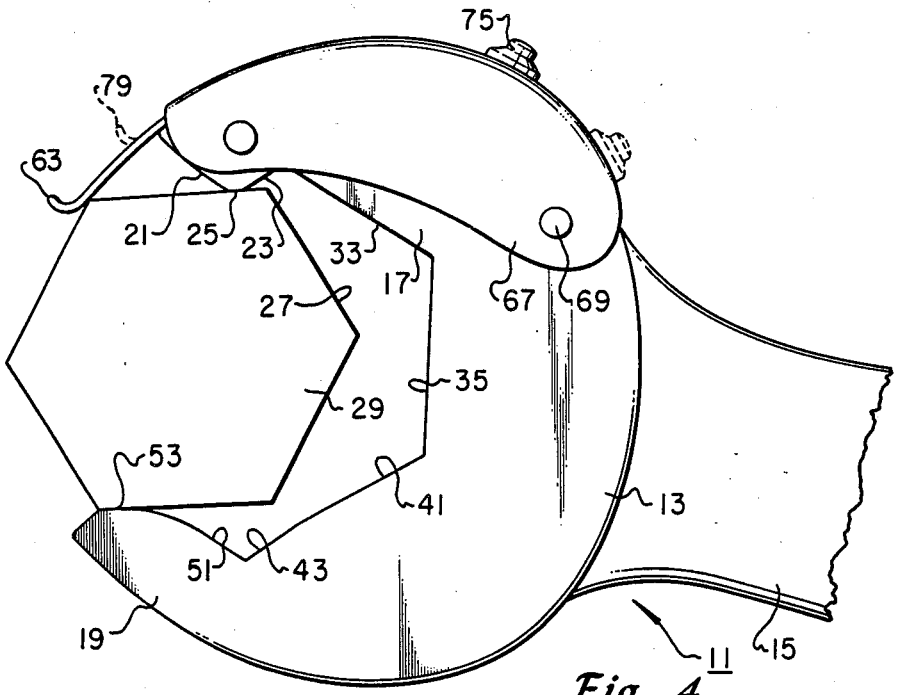
FIG. 4 is a side view of the wrench of FIG. 1, shown with a retainer installed.

Referring to FIG. 4, a retainer 63 can be placed on the wrench 11 of FIGS. 1–3. The purpose of the retainer 63 is to provide a stop or a guide for use in the secondary drive position shown in FIG. 3. The retainer 63 contacts the nut 29 as the wrench 11 is moved slightly rearward. This informs the user of the optimum secondary drive position.

Retainer 63 is preferably a resilient, flexible wire with an upwardly turned lip on the forward end. The wire 63 has two legs 65, as shown in FIG. 6. Each leg is slidably carried by a housing or channel 67. The channel 67 is a curved member constructed to fit closely over the upper jaw portion 17. Detents 69 snap the channel 67 releasably to the upper jaw portion 17. The legs 65 are also curved and terminate on the rear end in a slot 71 in channel 67, as shown in FIG. 7. Each leg 65 has an upwardly turned end 73 which engages the slot 71 to retain the legs 65 with the channel 67. A cap 75 (FIG. 4) fits over each end 73. The caps 75 are not shown in FIG. 7 for clarity. The slot 71 has a pair of cam surfaces 77 on one side. One end 73 will engage the cam surfaces 77 to hold the retainer 63 in a forward position, shown in FIG. 4, or an intermediate position, or a retracted position. The retracted position is indicated by the dotted line 79 in FIG. 4.

In the operation of the embodiment shown in FIGS. 4–7, because of the flexibility of the retainer 63, the wrench 11 may still be inserted around the nut 29 while the retainer 63 is fully extended. If so, the retainer 63 will flex as the nut 29 enters with a side 27 parallel to the lower stop face 51. The distance between the free end of the retainer 63 and the lower secondary drive face 53 is less than the distance between sides 27 of nut 29, as shown in FIG. 4. When moving to the secondary drive position, as wrench 11 is moved slightly rearward with a side 27 parallel to the lower secondary drive face 53, the retainer 63 will touch the point 31*f*. This informs the user of the optimum secondary drive position, and that he should begin applying torque.

If the user does not wish to use the retainer 63, he can remove the entire retainer 63 and channel 67 from the wrench 11. In the alternative, the user can leave the channel 67 on the wrench 11, and retract the retainer 63. He retracts the retainer 63 by pulling the end caps 75 rearward. On very small size wrenches, a fixed nonretractible spring retainer may be used. A fixed retainer on small size wrenches would not detract from the ability to apply or remove the wrench from the nut.

Figure 8:
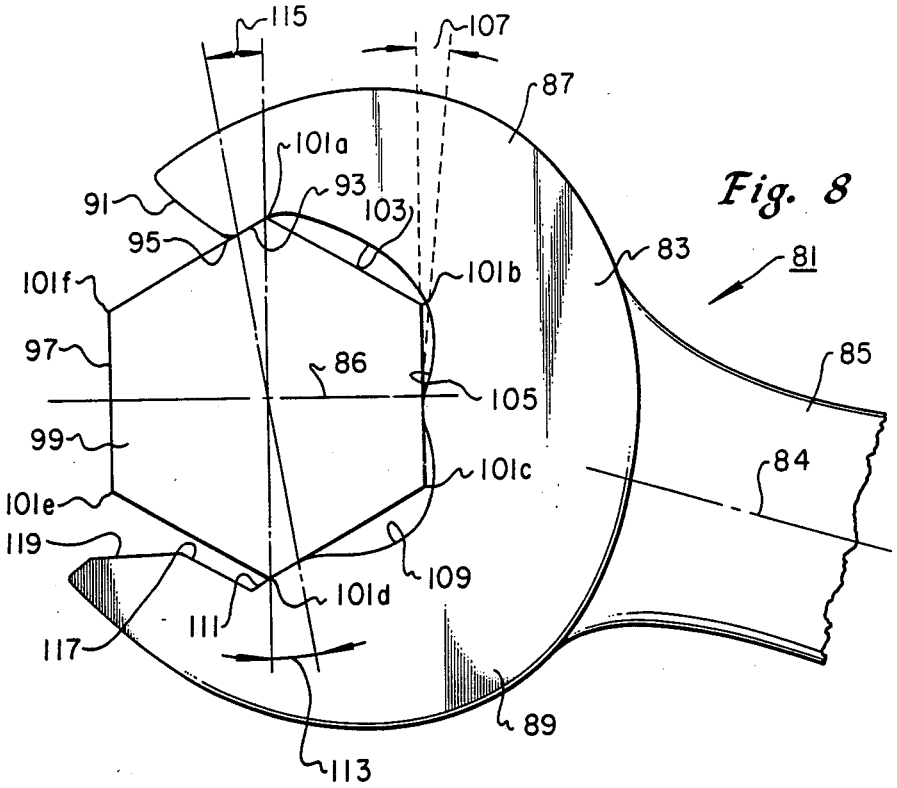
FIG. 8 is a side view of a second embodiment of a wrench constructed in accordance with this invention, and shown in the primary drive position.
Figure 9:
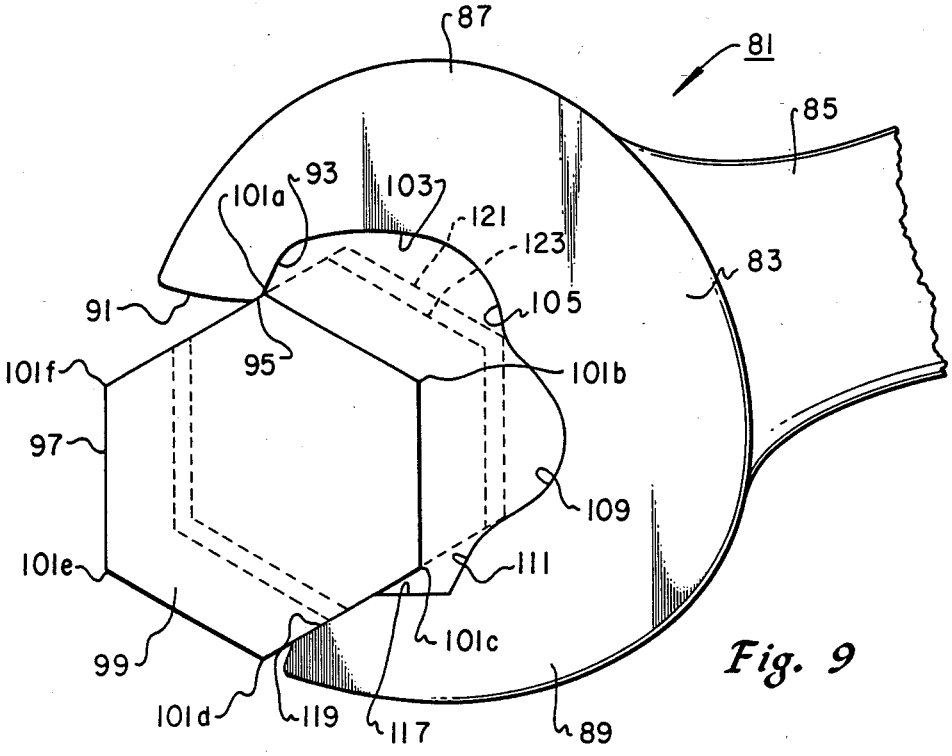
FIG. 9 is a side view of the wrench of FIG. 8, and shown in the secondary drive position.

FIGS. 8 and 9 show a second embodiment of a single piece ratchet type wrench. This embodiment will operate in the same manner as the embodiment of FIGS. 1–3. The extent of contact between the drive faces and the nut in the primary drive position is not quite as much as in the embodiment of FIGS. 1–3. An advantage of this second embodiment is that it may be made from existing wrench stock. Another advantage is that its configuration allows for the addition of a sliding pawl, shown in FIGS. 10–12. The sliding pawl permits totally self-seeking ratcheting in approximately 30 degree increments.

The wrench 81 has a jaw 83 joined to a shank 85. The axis 84 of the shank intersects the center line 86 of the jaw 83 at an angle of about 15 degrees. The center line 86 divides the jaw 83 into an upper jaw portion 87 and a lower jaw portion 89.

The upper jaw portion 87 has an upper free end 91. The upper free end 91 is substantially flat and lies at an angle of about 30 degrees relative to the center line 86. An upper primary drive face 93 extends rearward from the upper free end 91. The upper primary drive face 93 is flat and is at an angle of about 114 degrees relative to the upper free end 91. The junction between the upper free end 91 and the upper primary drive face 93 is a rounded area which serves as an upper secondary drive surface 95. Upper primary drive face 93 is at an angle relative to center line 86 of about 36 degrees.

The upper primary drive face 93 is adapted to engage a side 97 of a nut 99 while in the primary drive position shown in FIG. 8. The nut 99 is hexagonal, and has six points or corners, each located 60 degrees apart, and which are indicated by the numerals 101*a* through 101*f*.

An upper stop face 103 extends rearward from the upper primary drive face 93. The upper stop face 103 is a curved recess, and is concave when viewed in a side view as shown in FIG. 8. The length of the upper stop face 103 is selected so that its forward edge will contact point 101*a* of nut 99. The rearward edge will contact the next point 101*b*.

A back stop face 105 extends downward from the upper stop face 103. The back stop face 105 is a compound curve that protrudes forward in the middle. Recesses on each side of the center of the back face 105 provide a convex configuration to the back face 105 when viewed in a side view. In the primary drive position shown in FIG. 8, the side 97 approximately midway between the points 101*b* and 101*c* will touch the back stop face 105. The side 27 between the points 101*b* and 101*c* will be at an angle 107 relative to a line drawn tangent to the center point of backface 105 and perpendicular to the center line 86. Angle 107 is preferably six degrees.

A slide face 109 is in the lower jaw position 89 and extends forward from the back stop face 105. The slide face 109 is a concave curved surface. It provides a clearance for the point 101*c* when the wrench 81 is rotated to the next drive position. Normally, point 101*c* will not contact the slide face 109 during rotation to a new stroke, except at the forward edge of the slide face 109.

A flat lower primary drive face 111 joins the slide face 109. The lower primary drive face 111 is parallel to the upper primary drive face 93. The lower primary drive face 111 intersects the center line 86 at a 36 degree angle. A plane containing the lower primary drive face 111 would be spaced from a plane containing the upper primary drive face 93 by a distance equal to the distance between sides 97 of the nut 99, plus a manufacturing tolerance. The primary drive faces 93 and 111 drive on a plane surface of the side 97 of the nut 99. The extent of contact is proportional to the angles 113 and 115. Angles 113 and 115 are each about eight degrees.

A lower stop face 117 extends forward from the lower primary drive face 111. The lower stop face 117 intersects the lower primary drive face 111 at an obtuse angle of about 114 degrees. The lower stop face 117 is parallel to the upper free end 91. The perpendicular distance between planes containing the upper free end 91 and the lower stop face 117 is equal to the distance between sides 97 of nut 99, plus a manufacuring tolerance.

A lower secondary drive face 119 extends forward from the lower stop face 117. The lower secondary drive face 119 is flat and is parallel to the center line 86. The lower secondary drive face 119 intersects the lower stop face 117 at an angle of about 210 degrees.

In the operation of the embodiment of FIGS. 8 and 9, torque is applied in the primary drive position that is shown in FIG. 8. To stroke from the primary drive position to a secondary drive position, shown by the solid lines in FIG. 9, the user rotates the wrench 81 in the reverse direction for approximately 30 degrees, but more precisely about 24 degrees. Light forward pressure is maintained on the wrench 81 during the reverse rotation. During this rotation, the side 97 between points 101*b* and 101*c* will slide on the center point of the back stop face 105. Point 101*a* will slide on the forward portion of the upper stop face 103. The points 101*c* and 101*d* will not contact the lower jaw portion 89.

When the wrench reaches the position relative to nut 99 represented by the dotted lines 121 in FIG. 9, the side 97 between the points 101*c* and 101*d* will be parallel to the lower secondary drive face 119. The user then moves the wrench 81 rearward. The secondary drive position exists at any point between the dotted lines 123 and the solid lines shown in FIG. 9. The upper secondary drive surface 95 will contact the side 97 between the points 101*f* and 101*a*, and near point 101*a*. The lower secondary drive face 119 will contact the side 97 between the points 101*c* and 101*d*, and closer to point 101*d*.

Similar to the embodiment of FIGS. 1–3, a reverse torque can be applied while in the secondary position shown in FIG. 9. The reverse torque position is not shown, but would involve rotating the wrench in the reverse direction. The upper secondary drive surface 95 would contact the nut side 97 near the point 101*f*. The lower secondary drive face 119 would contact the side 97 between the points 101*c* and 101*d*, and nearer to the point 101*c*.

To move from the secondary drive position to the primary drive position, the wrench 81 is pushed forward relative to nut 99 and rotated about 36 degrees. During this rotation, the upper secondary drive surface 95 will slide on one of the sides 97 until passing one of the points 101. One of the points 101 will slide on the back stop face 105. One of the points 101 will slide on the rearward portion of the lower primary drive fce 111.

The wrench of FIGS. 8 and 9 will also operate by rotating a full 60 degrees with each stroke. In addition, a retainer such as the retainer 63 could be used with the wrench of FIGS. 8 and 9.

Figure 10:
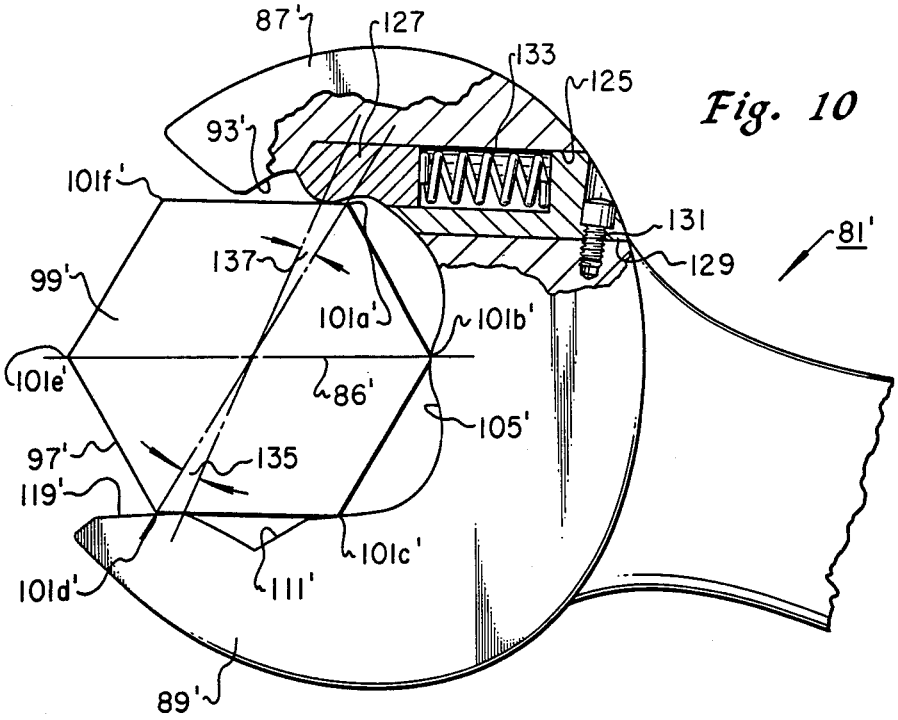
FIG. 10 is a side view of a third embodiment of a wrench constructed in accordance with this invention, and shown in the primary drive position.
Figure 12:
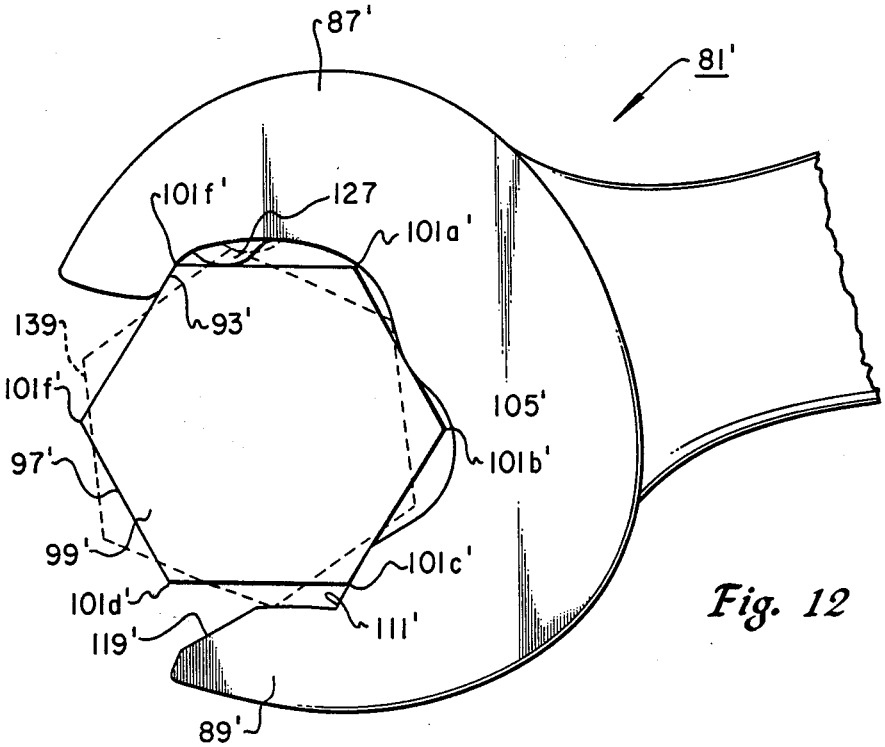
FIG. 12 is a side view of the wrench of FIG. 10, and shown in a secondary drive position.

The embodiment shown in FIGS. 10–12 has the same configuration as the wrench 81. Common elements will be shown by a prime symbol. Wrench 81' differs from wrench 81 in that it has a passage 125 extending through the upper jaw portion 87'. Passage 125 is parallel to the center line 86'. A pawl 127 is slidingly carried in the passage 125. Pawl 127, as shown in FIG. 11, is somewhat bullet-shaped. The lower side of the pawl 127 protrudes into the space between the upper jaw portion 87' and the lower jaw portion 89'. Pawl 127 is reciprocally carried on a carrier 129 which is rigidly secured in passage 125. A screw 131 secures the carrier 129 in the passage 125. A spring 133 urges the pawl 127 forward relative to the carrier 129.

In the primary drive position shown in FIG. 10, the lower surface of the pawl 127 serves as the upper secondary drive surface. The force on the pawl 127 during right hand torque is upward. Consequently, the pawl 127 will not retract. The lower secondary drive face 119' drives on an opposite side 97' of the nut 99'.

In the secondary drive position, a point 101*b'* will be touching the center of the back stop face 105'. Note that in the embodiment of FIGS. 8 and 9, during the secondary drive position, the point 101*b* is spaced from the back stop face 105. The pawl 127 contacts a plane surface of side 97' for a distance that is proportional to the angle 137. The lower secondary drive face 119' contacts a plane surface of side 97' in parallel contact for a distance proportional to the angle 135. Angles 135 and 137 are each about eight degrees.

When rotating from the secondary drive position shown in FIG. 10 to the primary drive position shown in FIG. 12, the wrench 81' will rotate relative to the nut 99' as indicated by the dotted lines 139. The point 101*f'* will push the pawl 127 back, compressing spring 133 (FIG. 10). The point 101*c'* will slide on the lower primary drive face 111'. The primary drive position is shown by the solid lines in FIG. 12. In this position, the pawl 127 has no effect. Driving is handled by the upper primary drive face 93' and the lower primary drive face 111'. Wrench 81' will ratchet in approximately 30 degree strokes, as previously described, or in 60 degree strokes. Also, wrench 81' will operate with reverse torque when in the secondary drive position, as described in connection with the other embodiments.

The invention has significant advantages. In all of the embodiments, the wrench seeks the next primary drive position automatically. Pressure of the wrench against the nut can be maintained during movement to the next drive position. It is not necessary to withdraw the wrench when ratcheting from a primary drive positions 60 degrees to another primary drive position. A secondary drive position approximately 30 degrees from the primary drive position is available if needed. The wrench drives on a flat plane of the nut, rather than on the nut corner. The distance between the respective drive surfaces in all cases is the exact dimension of the nut, providing excellent gripping ability. The gripping ability of the wrench is equal or superior to any standard fixed jaw open end wrench. It is easier to place the wrench on a nut than the standard open end wrench because of the greater width between the free ends of the jaw. When placing the wrench on the nut, it seeks the initial drive position automatically.

While the invention has been shown in only a few of its forms, it should be apparent to those skilled in the art that it is not so limited, but is susceptible to various changes without departing from the scope of the invention.

I claim:

1. A wrench for use with a hexagonal nut, comprising in combination:

a jaw joined to a shank and having upper and lower jaw portions rigidly formed together so as to be immovable relative to each other and separated from each other by a center line of the jaw;

an upper primary drive face located on the upper jaw portion for engaging a side of the nut to apply torque only when the wrench is in a primary drive position;

an upper secondary drive surface located on the upper jaw portion adjacent the upper primary drive face for engaging a side of the nut only when the wrench is in a secondary drive position, the shank being located in the secondary drive position substantially less than 60 degrees in reverse rotation relative to the nut from the position of the shank while in the primary drive position;

a lower primary drive face in the lower jaw portion, opposite from and parallel to the upper primary drive face, for engaging a side of the nut opposite from the side engaged by the upper primary drive face when the wrench is in the primary drive position, the lower primary drive face lying at an acute angle relative to the center line of the jaw;

a lower secondary drive face located forward of the lower primary drive face, the lower secondary drive face being substantially parallel to the center line of the jaw, the lower secondary drive face adapted to engage a side of the nut opposite the side engaged by the upper secondary drive surface when the wrench is in a secondary drive position;

a rear stop face at the junction of the upper and lower jaw portions, for contacting the nut when the wrench is in the primary drive position;

an upper stop face located forward of the rear stop face on the upper jaw;

a lower stop face located between the lower primary and secondary drive faces and opposite the upper stop face; and the distance between the upper and lower stop faces being greater than a point-to-point diameter of the nut, to enable the wrench to be rotated between drive positions without removing the wrench from the nut.

2. The wrench according to claim 1 wherein the upper primary drive face is located at an angle a selected amount greater than 30 degrees relative to the center line of the jaw.

3. The wrench according to claim 1 wherein a plane containing the lower secondary drive face intersects a plane containing the lower primary drive face at an obtuse angle a selected amount less than 150 degrees.

4. An open end wrench for use with a hexagonal nut, comprising in combination:

a jaw joined to a shank and having upper and lower jaw portions rigidly formed together so as to be immovable relative to each other, each terminating in a free end spaced apart from each other, the jaw portions being separated from each other by a center line;

an upper primary drive face located on the upper jaw portion and facing rearward and downward at an acute angle slightly greater than 30 degrees relative to the center line for engaging a side of the nut to apply torque only when the wrench is in a primary drive position;

an upper secondary drive surface located on the upper jaw at the junction of the upper primary drive face and the free end of the upper jaw portion for engaging a side of the nut only when the wrench is in a secondary drive position, in the secondary drive position the shank being located substantially less than 60 degrees in reverse rotation relative to the nut from the position of the shank while in primary drive position;

a lower primary drive face in the lower jaw portion, opposite from and parallel to the upper primary drive face, for engaging a side of the nut opposite from the side engaged by the upper primary drive face when the wrench is in the primary drive position;

a lower secondary drive face located forward of the lower primary drive face, the lower secondary drive face adapted to engage a side of the nut opposite the side engaged by the upper secondary drive surface when the wrench is in a secondary drive position, the lower secondary drive face being substantially parallel to the center line;

a rear stop face at the junction of the upper and lower jaw portions, for contacting a side of the nut substantially 90 degrees from the side being contacted by the primary drive face when the wrench is in the primary drive position, and for slidingly contacting a part of the nut at the commencement of a rotating movement of the wrench relative to the nut from the primary drive position to the secondary drive position;

the rear stop face being spaced a substantial distance from the nut when the wrench is in the secondary drive position;

an upper stop face located forward of the rear stop face on the upper jaw portion;

a lower stop face located between the lower primary and secondary drive faces and opposite the upper stop face, the lower stop face intersecting the lower secondary drive face at an obtuse angle; and the distance between the upper and lower stop faces being greater than a point-to-point diameter of the nut, to enable the wrench to be rotated between drive positions without removing the wrench from the nut.

5. The wrench according to claim 4, further comprising:

a slide face extending from a rearward edge of the lower primary drive face to a lower edge of the rear stop face, the slide face being recessed downward from a plane containing the lower primary drive face for slidingly contacting a point of the nut when rotating the wrench from the primary drive position to the secondary drive position.

6. The wrench according to claim 4 wherein the free end of the upper jaw portion and the lower stop face are substantially parallel to each other.

7. An open end wrench for use with a hexagonal nut, comprising in combination:

a jaw joined to a shank and having upper and lower jaw portions rigidly formed together so as to be immovable relative to each other, each terminating in a free end spaced apart from each other;

an upper primary drive face joining the free end of the upper jaw portion and facing rearward and downward for engaging a side of the nut to apply torque only when the wrench is in a primary drive position;

an upper secondary drive surface located on the upper jaw at the junction of the upper primary drive face and the free end for engaging a side of the nut only when the wrench is in the secondary drive position, in the secondary drive position the shank being substantially less than 60 degrees in reverse rotation relative to the nut from the position of the shank while in the primary drive position;

an upper stop face extending rearward from the upper primary drive face for a distance substantially equal to the length of one side of the nut, the upper stop face being a concave curved shape;

a rear stop face joining a rearward edge of the upper stop face and extending downward for a distance substantially equal to the length of one side of the nut, the rear stop face being a convex curved shape;

a slide face joining the lower edge of the rear stop face and extending forward a distance less than the length of one side of the nut;

a lower primary drive face joining a forward edge of the slide face and extending forward and downward in a plane substantially parallel with the plane containing the upper primary drive face, for engaging a side of the nut opposite from the side engaged by the upper primary drive face when the wrench is in the primary drive position;

a lower stop face joining the forward edge of the lower primary drive face and extending upward and forward from the lower primary drive face;

a lower secondary drive face joining a forward edge of the lower stop face and extending forward to a point adjacent the free end of the lower jaw portion;

the distance between the upper stop face and the lower stop face being greater than a point-to-point diameter of the nut, the distance between planes containing the free end of the upper jaw portion and the lower stop face being substantially a side-to-side diameter of the nut, the distance between planes containing the upper primary drive face and the lower primary drive face being substantially the side-to-side diameter of the nut, the distance from the upper primary drive face to the slide face being greater than the side-to-side diameter of the nut, so that during rotational movement from the primary drive position to the secondary drive position with a forward force applied to the nut with the wrench, the upper stop face and the rear stop face will slide on a point of the nut until the lower secondary drive face becomes parallel with a side of the nut, allowing the wrench to be moved rearward relative to the nut to locate the upper secondary drive surface and the lower secondary drive face into engagement with the nut.

8. A method of applying torque to a nut, comprising in combination:

providing a wrench with a jaw having upper and lower portions rigidly formed together so as to be immovable relative to each other;

providing in the upper jaw portion a primary drive face and a secondary drive surface;

providing in the lower jaw portion a lower primary drive face and a lower secondary drive face;

placing the wrench on the nut with the upper and lower primary drive faces engaging sides of the nut and rotating the wrench in a first direction to apply torque;

while applying forward pressure of the wrench against the nut, rotating the wrench in a direction opposite to the first direction for approximately 30 degrees until the lower secondary drive face is parallel with a side of the nut; then moving the wrench rearward relative to the nut a selected distance; then rotating the wrench in the first direction to cause the upper secondary drive surface and the lower secondary drive face to engage opposite sides of the nut to apply torque; then rotating in the direction opposite to the first direction while applying forward pressure on the wrench against the nut until the upper and lower primary drive faces contact opposite sides of the nut; then rotating in the first direction again to apply torque.

* * * * *